US006351978B1

(12) United States Patent
Kusakabe et al.

(10) Patent No.: US 6,351,978 B1
(45) Date of Patent: Mar. 5, 2002

(54) ROLLER MOUNT WITH THREE-AXIS FREEDOM

(75) Inventors: Yukio Kusakabe, Kobe; Kazuo Omura, Kakogawa; Hirokazu Mori, Kobe, all of (JP)

(73) Assignee: Kusakabe Electric & Machinery Co., Kobe (JP)

( * ) Notice: Subject to any disclaimer, the term of this patent is extended or adjusted under 35 U.S.C. 154(b) by 0 days.

(21) Appl. No.: 09/340,998

(22) Filed: Jun. 28, 1999

(30) Foreign Application Priority Data

Jun. 29, 1998 (JP) ..... 10-182914

(51) Int. Cl.[7] ..... B21D 39/02

(52) U.S. Cl. ..... 72/52

(58) Field of Search ..... 72/51, 52; 228/17, 228/17.5, 147

(56) References Cited

U.S. PATENT DOCUMENTS

| | | | | | |
|---|---|---|---|---|---|
| 3,204,847 | A | * | 9/1965 | Vitense | 413/69 |
| 4,709,845 | A | | 12/1987 | Akiyama et al. | 228/17 |
| 4,747,289 | A | * | 5/1988 | Nakamura | 72/52 |
| 4,776,194 | A | * | 10/1988 | Chang | 72/52 |
| 4,947,671 | A | * | 8/1990 | Lindstrom | 72/52 |
| 5,140,123 | A | | 8/1992 | Mitani | 219/61.2 |
| 5,607,098 | A | | 3/1997 | Kusakabe et al. | 228/17 |
| 5,673,579 | A | | 10/1997 | Hashimoto et al. | 72/52 |
| 5,784,911 | A | | 7/1998 | Hashimoto et al. | 72/52 |
| 5,865,053 | A | * | 2/1999 | Abbey, III et al. | 72/52 |

* cited by examiner

*Primary Examiner*—Ed Tolan
(74) *Attorney, Agent, or Firm*—Baker & McKenzie

(57) ABSTRACT

A roller mounting arrangement for a machine in which elongated material is shaped by rollers as the material progresses along a pathway. The rollers are mounted so that they are free to pivot and distribute forming pressure over a wider area of the material being shaped. The rollers have freedom to pivot about a plurality of axes. In a tandem mounting arrangement, the rollers have 3-axis freedom.

11 Claims, 12 Drawing Sheets

ROLLER MOUNT WITH THREE-AXIS FREEDOM

BACKGROUND AND SUMMARY OF THE INVENTION

The present invention relates to a mounting arrangement for a roller used in the processing of an elongated piece of material. In particular, the invention has application in the support for rollers used in the manufacture of welded steel pipes.

For many years, steel pipe has been produced by bending a sheet of steel into a tubular form and then welding the edges of the strip along a seam. Equipment utilizing various series of breakdown rolls, cage rolls and fin-pass rolls are in widespread use. For example, reference may be made to U.S. Pat. No. 5,140,123 which shows a method and apparatus for continuously manufacturing a metal tube. An earlier example of such machinery and techniques is shown in U.S. Pat. No. 4,709,845. Refinements of the types of machines shown in the foregoing patents are described in U.S. Pat. Nos. 5,607,098; 5,673,579; and 5,784,911.

In traditional tube forming machinery in which rollers of various shapes are used to bend sheet steel into a tubular shape, it has been assumed that the precise position of each roller should be set and held fixed. In conventional machines, the horizontal and vertical location of the rolls, along with the angular position of the axis of the forming rolls, has been adjusted and set to a specific value depending upon such factors as the particular thickness of the sheet being processed, the type of steel (i.e., stainless, etc.), the hardness and quality of the material, and the shape of the desired end product. In situations where the steel is to be processed through the tube forming machines is of lower and more variable quality, the fixed position of the rolls can create difficulties relating to twisting, excessive loading of the rollers, threading of the strip through the machine and marking of the surface of the steel processed by the machine. If the steel processed by the machine varies from sheet to sheet because, for example, of variations in the processes used to make the steel which comprises the sheet, such variations can create significant handling difficulties when such sheets arc used to make tubes.

Variations in properties such as hardness and surface characteristics may mean that frequent adjustments in the positions of the rolls used to process such material are required. In a continuous tube forming process, stoppage of the process to adjust the positions of the forming rolls is quite problematic. As an alternative to stopping the machine in order to make adjustments, forcing the material through the machine can result in excessive loading of the rolls, resulting in excessive wear of both the rolls and the bearings for the rolls, and the creation of roll marks on the surface of the tube being processed.

Another difficulty associated with the use of rolls with positions which are fixed is that threading of the sheet through the machine for purposes of initial start-up can be difficult, particularly where the material of the sheet has inconsistencies in the properties of the material. With certain materials, the sheet when held by fixed rolls will tend to twist and distort, making threading of the sheet through the machine very difficult.

At least some of the foregoing problems and disadvantages of conventional tube forming machinery are solved by use of the present invention wherein rolls in the cage zone of a tube forming machine are flexibly supported such that they are free to rotate about a plurality of axes. A roller mount of the present invention includes a typical vertical frame for supporting a cage roll. However, the roller itself is mounted so that it is free to pivot in an X-Y plane. In addition, the roller is mounted on a swivel bearing carried by the main vertical frame so that the angular position of the axis of the roller is free to pivot in a Y-Z plane of the machine, as well, which is explained more fully below.

In machines in which the cage rollers are mounted in pairs, the pair of cage rolls are additionally mounted so that they are free to pivot in an X-Z plane of the machine. Thus, in a conventional tube-forming machine wherein a pair of cage rollers is used, the cage rolls are mounted so that they have freedom of movement about three axes.

The advantages of the present invention will be better understood upon a reading of the following specification, read in conjunction with the accompanying drawings, wherein:

DETAILED DESCRIPTION OF AN EXAMPLE OF THE INVENTION

As used herein, the axes of a tube forming machine are the X, Y and Z axes, and those axes are defined as follows: the Z-axis is the longitudinal axis, i.e., the one which corresponds to the direction of movement of a sheet along a pathway through the machine; the X-axis is the horizontal axis, which is transverse to the Z-axis; and the Y-axis is the vertical axis, which is also transverse to the Z-axis. These axes are also used to define planes discussed herein, e.g., X-Y planes, which are generally perpendicular to both the Z-axis and the direction of work movement; Y-Z planes, which are vertically oriented and longitudinally extending planes; and X-Z planes, which are horizontally oriented and longitudinally extending planes.

Figure 1:
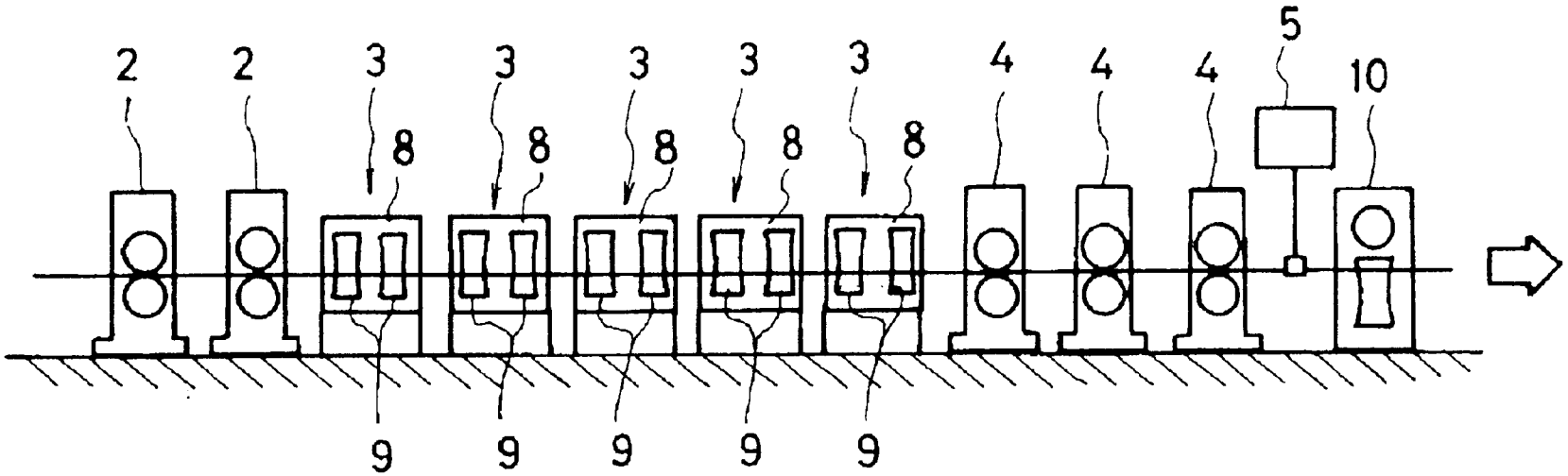
FIG. 1 is a side elevational view showing the overall layout of a continuous tube making machine.

FIG. 1 is a side-elevational view of one type of a tube forming machine in which the present invention is useful. In the machine shown in FIG. 1, a steel strip is first engaged by a series of two breakdown roll stands 2. Generally, one or more of the breakdown rolls are driven by motors to provide the driving force which pushes the steel strip through the machine. In this example, there are two breakdown roll stands. However, in other machines, a different number of breakdown roll stands may be used, and one or more may be equipped with motors for purposes of driving the strip through the machine. In the example shown in FIG. 1, five cage roll stands 3 then work on the strip in series, each having a pair of forming rolls 9. In each cage roll stand 3, there is a pair of forming rolls 9 mounted on each side of the cage roll stand 3 by a mounting mechanism 8 with three-axis freedom. After the vertically mounted forming rolls 9 complete their processing, the strip is fed to the fin pass roll stands 4 of which there are three shown in the machine shown in FIG. 1. After the fin pass roll stands 4, the edges of the strip are welded together by a high frequency welder 5, and in the final step, are processed by a squeeze roll stand 10.

Figure 2:
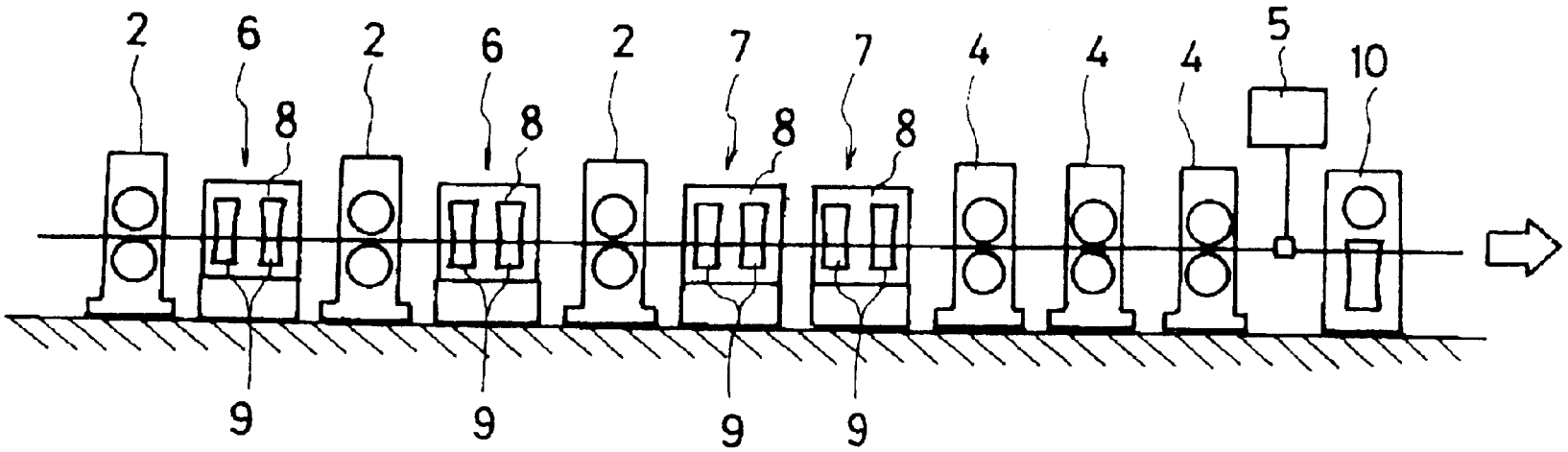
FIG. 2 is a side elevational view of an alternative layout of a continuous tube making machine.

Because tubes manufactured by a machine embodying the present invention may have walls of different thickness, may have different diameters, and may be made of various materials, the machines may have alternative combinations of forming rolls, such as is shown in FIG. 2. In FIG. 2, a series of alternating horizontally and vertically mounted rollers are used to form a strip into a tube. Initially, as shown in FIG. 2, a breakdown roll stand 2 is followed by a side roll stand 6 in which forming rolls 9 are held by a mechanism 8 with three-axis freedom. The third roll stand is another breakdown roll stand 2, which is, in turn, followed by a second side roll stand 6. Then, another breakdown roll stand 2 with horizontally mounted rollers, is followed by two cluster roll stands 7 in series, each stand having pairs of adjacent forming rolls 9, and each pair of forming rolls 9 being held by a mechanism 8 with three-axis freedom. Again referencing FIG. 2, four thin pass roll stands 4 are used to bring the edges of the strip together, after which they are welded by the high frequency roller 5 and finally processed by the squeeze roll stand 10. It should be noted that the diagrams of FIGS. 1 and 2 show the vertically oriented forming rolls 9 as a pair. However, for each pair of vertically mounted forming rolls 9 shown in FIGS. 1 and 2, there is a pair of opposing rolls which are not shown.

Figure 3:
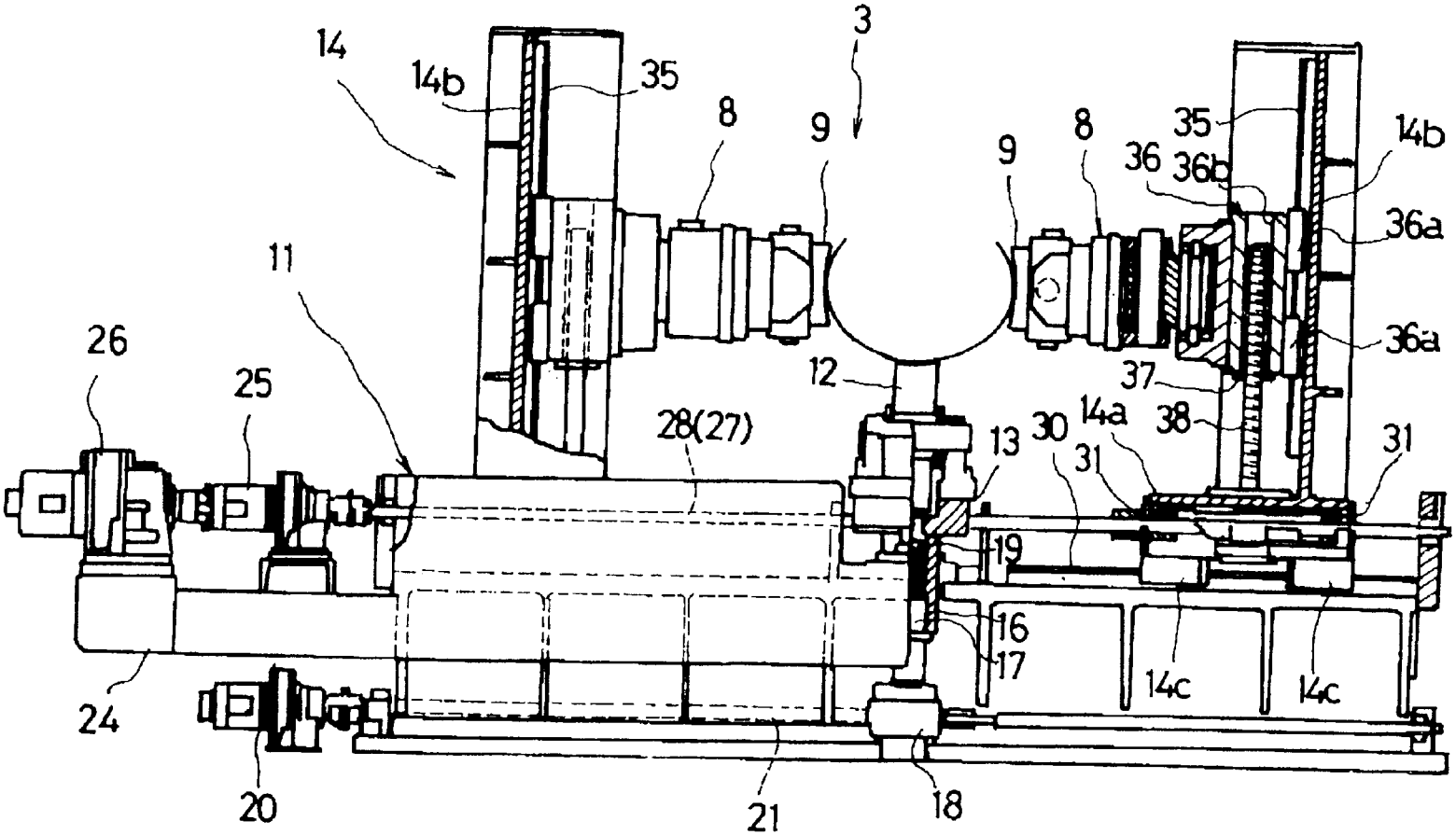
FIG. 3 is an end elevational view, in partial section, of a cage roll stand embodying an example of the present invention.

FIG. 3 is an end view in partial section of the pathway of a tube forming machine at a location where a strip is contacted by a pair of opposing forming rolls 9. The forming rolls 9 are held in place by the main vertical frames 14 of which two are shown in FIG. 3. The two main vertical frames and related components thereof are mirror images of one another, one on each side of the strip being processed. With reference to FIG. 3, the mechanisms 8 with three-axis freedom which are used to support the forming rolls 9 are mounted to a vertical slide frame 35 by a swivel bearing 40. The slide frame 35 moves along a vertical slide rail 36 by the use of vertical slide bearings 36*a*. A vertical sleeve frame 36*b* has a nut 37 mounted at the lower end thereof, which surrounds a rotatable male screw shaft 38, the rotation of which causes upward and downward adjustment of the height of the forming roll 9. The height adjustment motor 25 causes simultaneous rotation of the screw shafts 38 on the right and left side of the cage roll stand 3. The width adjusting motor 26, which is supported on a base 24, is used to adjust the extent to which the forming rolls 9 in a particular cage roll stand are separated. The height and width adjusting motors 25 and 26, respectively, are connected to the main vertical frames 14 by the height and width adjusting shafts 28 and 27, respectively, with shaft 28 being a spline shaft and shaft 27 being a screw shaft. Width adjustment results from rotation of the threaded shaft 27 within the screw rings 31 connected to the base 14*a*. The weight of the components mounted to the main vertical frame 14 is transferred to the main horizontal slide rail 30 by the horizontal slide bearing 14*c*. The bottom roll 12 has a height adjusting motor 20 which is connected by drive shaft 21 to a worm and worm wheel gearbox 18 to cause rotation of male screw shaft 19 within the nut 17, which results in upward or downward movement of the bottom roll holder 13. The male screw shaft 19 and nut 17 are contained within the sleeve frame 16.

Figure 4:
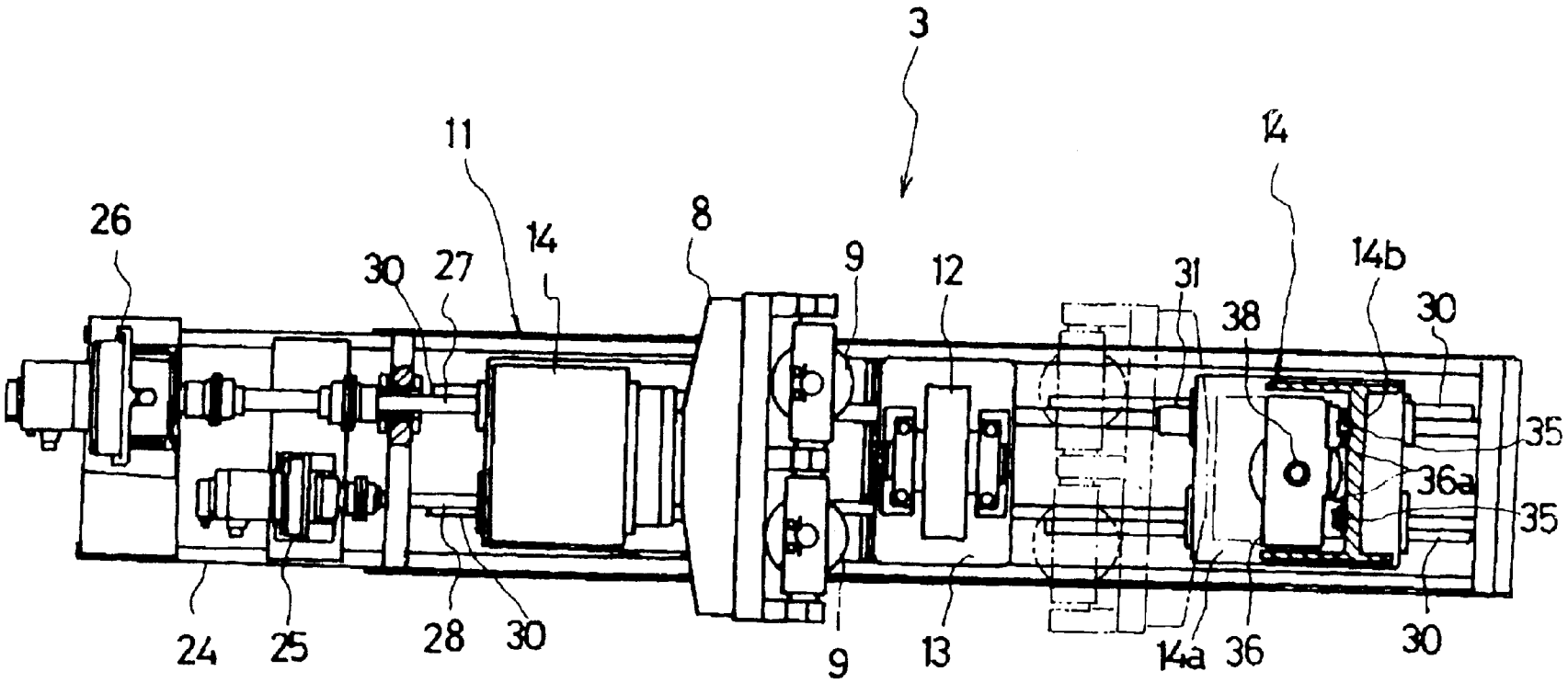
FIG. 4 is a top plan view of the cage roll stand shown in FIG. 3.
Figure 5:
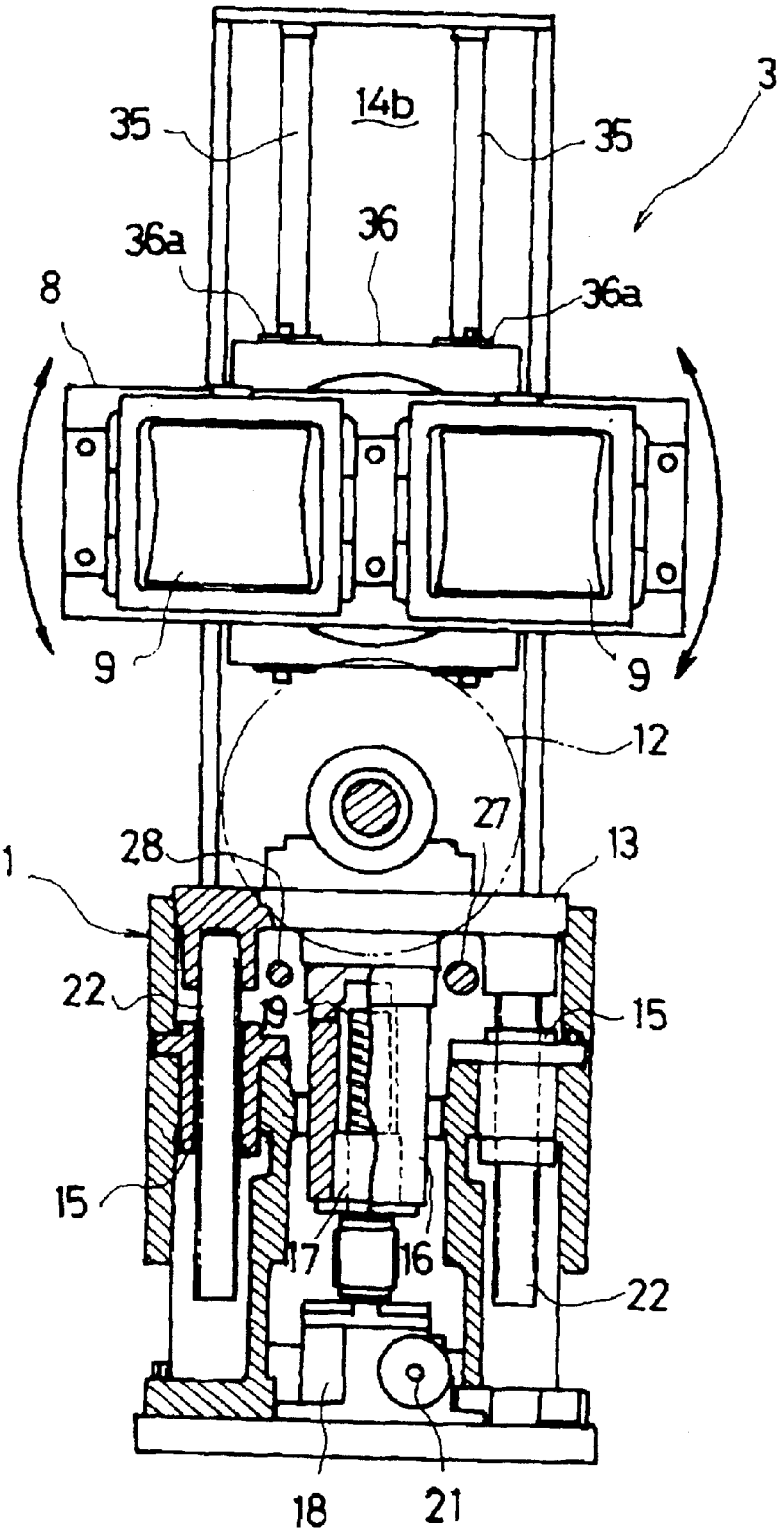
FIG. 5 is a front elevational view, in partial section, of two rollers in a cage roll stand.

With reference to FIGS. 3, 4 and 5, the width and height adjustment drive shafts extend through the main horizontal frame 11. A guide sleeve 15 surrounds the guide rod 22 as part of the height adjustment of the bottom roll 12.

Figure 6:
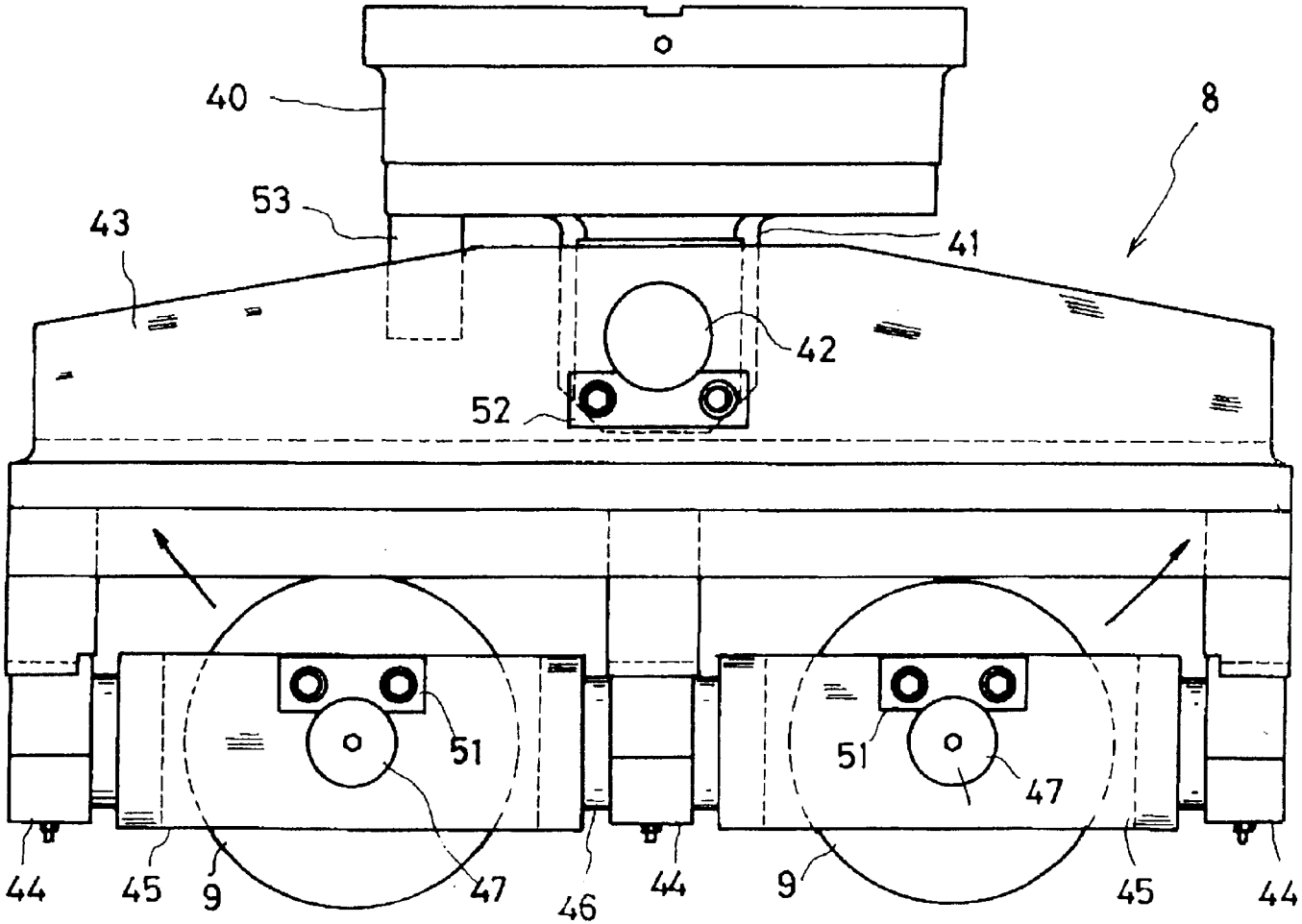
FIG. 6 is a top plan view of the components used to support the forming rolls in a manner in accordance with the present invention.
Figure 7:
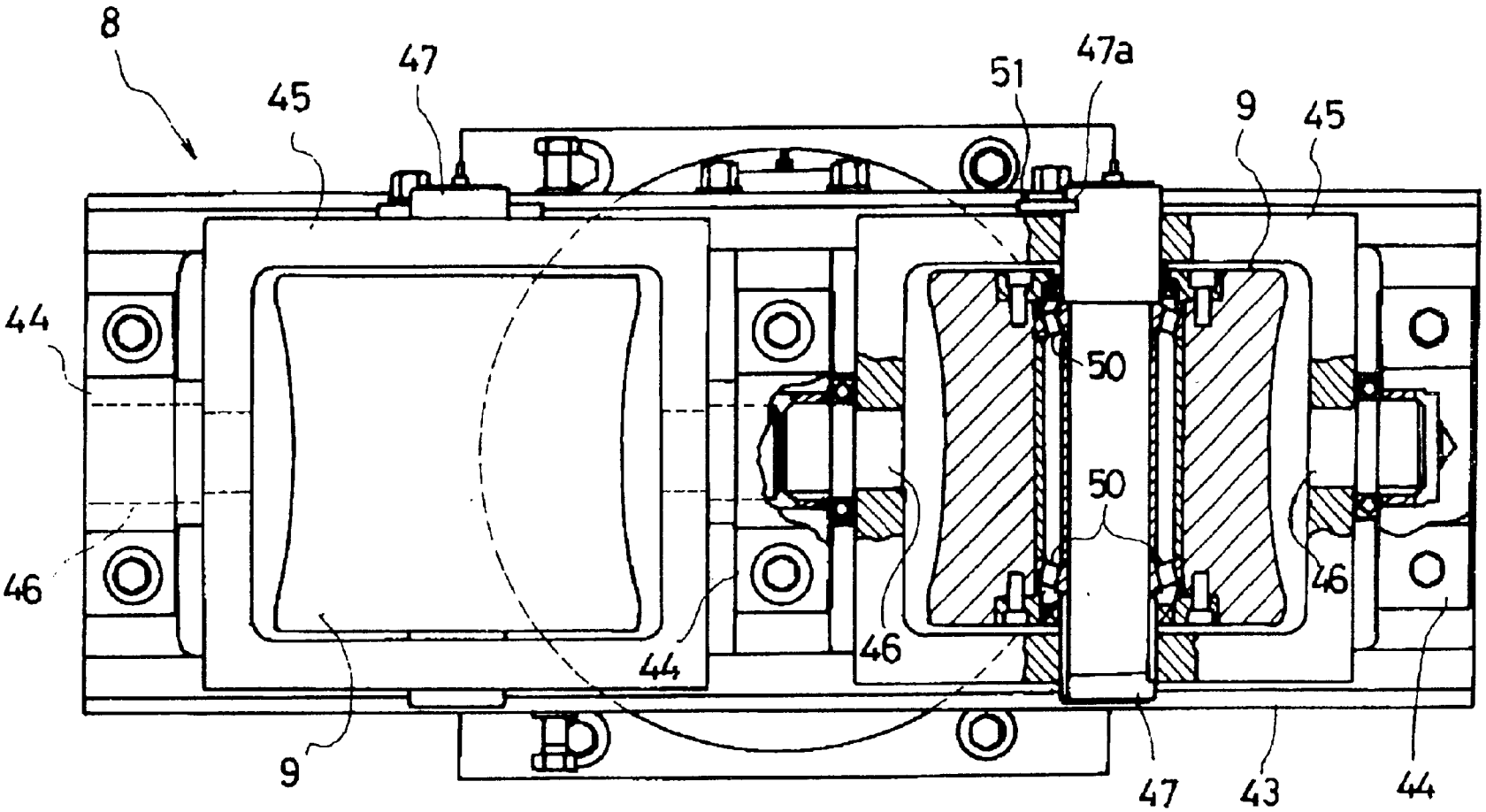
FIG. 7 is a front elevational view of the forming rolls shown in FIG. 6.
Figure 8:
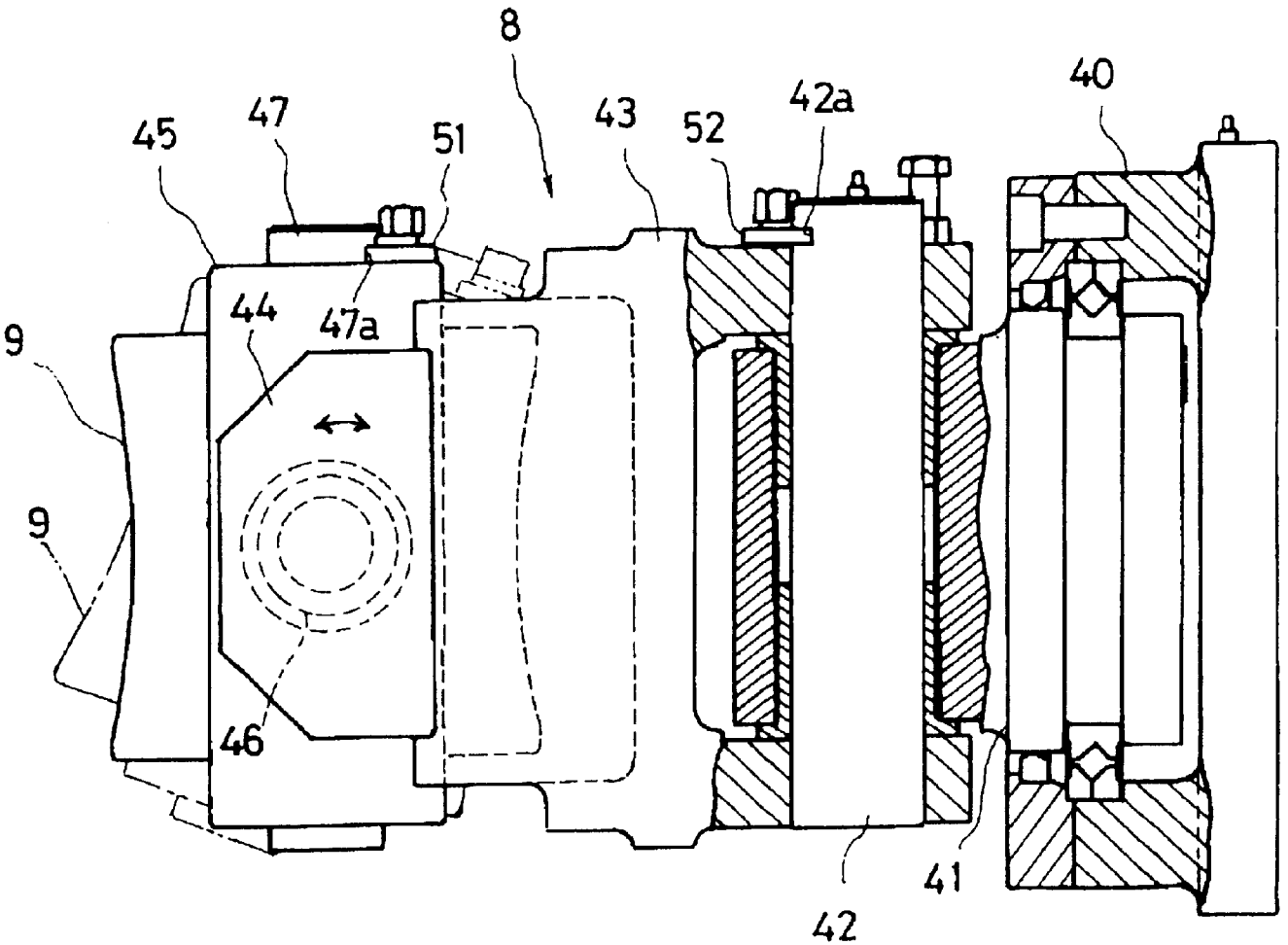
FIG. 8 is an end view of the forming roll support components shown in FIGS. 6 and 7.

FIGS. 6, 7 and 8 are top, side and end views (with FIGS. 7 and 8 in partial section) of the mechanism 8 with three-axis freedom used to flexibly support the forming rolls 9 as they engage a strip being processed by the machine shown in FIGS. 1, 2 and 3. Each forming roll 9 has a roll shaft 47, the ends of which are held by a roll holder 45. A roll shaft keeper plate 51 is used to secure the shaft 47 in position within the roll holder 45. The roll holder 45 is rotatably mounted to a pivot frame 43 by swing shaft bearings 44, each of which surrounds and supports a roll holder swing shaft 46. The pivot frame 43 is mounted by the pivot shaft 42 to the swivel bearing 40 by the pivot shaft holder 41. The pivot frame 43 is rotatable about the pivot shaft 42, as indicated by the unnumbered arrows in FIG. 6, providing the forming rolls 9 with freedom to move in an X-Z plane. A pivot shaft keeper plate 52 fits into a keeper plate groove 42*a* on the pivot shaft 42. Similarly, the roll shaft keeper plate 51 fits into a keeper plate groove 47*a* on the roll shaft 47. As can be seen in FIG. 7, the roll bearings 50 allow free rotation of the forming rolls 9 about the roll shafts 47. A stopper bar 53 limits the movement of the pivot frame 43 in the directions shown by the unnumbered arrows in FIG. 5, i.e., movement in Y-Z planes.

With reference to FIG. 8, the dotted line position of the forming roll 9' and the unnumbered arrow in FIG. 8, indicate the moveability of the forming roll 9 in the X-Y plane. The movement of the pivot frame 43 about the pivot shaft 42 provides the forming rolls 9 with freedom to move in X-Z planes, and movement of the pivot frame 43 within the swivel bearing 40 about the pivot shaft holder 41 provides the forming rolls with freedom to move in Y-Z planes. Thus, the forming rolls have three-axis freedom.

Figure 9:
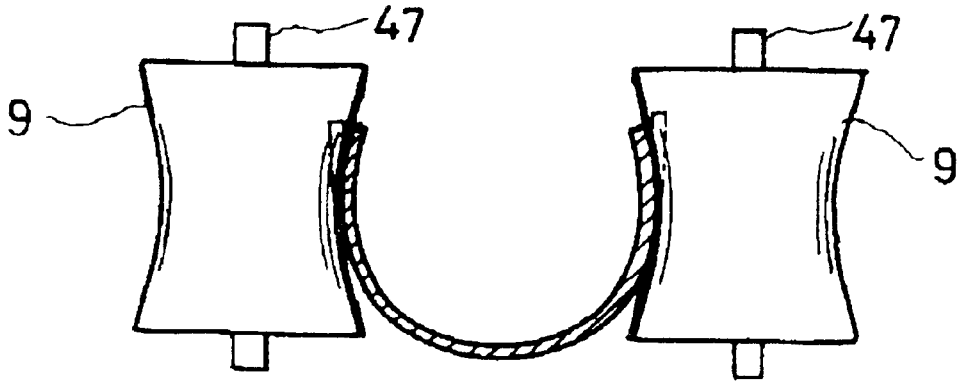
Fig. 9 (PRIOR ART)
FIG. 9 is a schematic diagram of a cage roll arrangement of the prior art.
Figure 10:
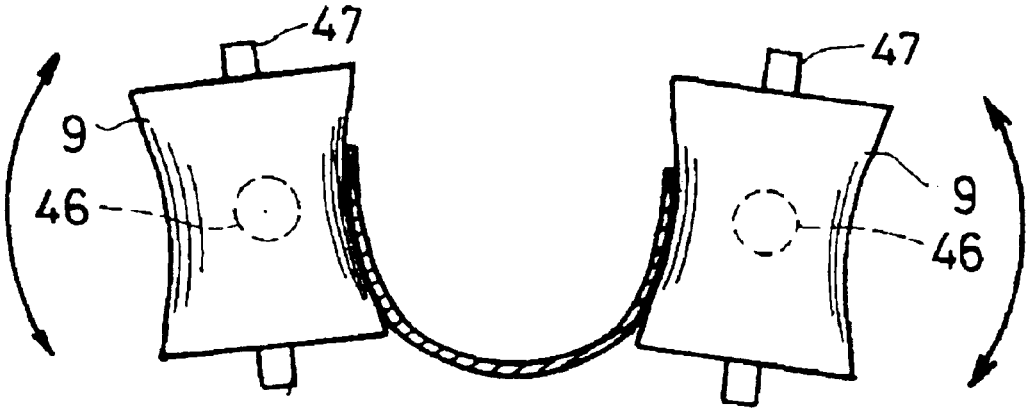
FIG. 10 is a schematic diagram of a forming roll mounting arrangement embodying the present invention.

FIGS. 9 and 10 contrast the conventional or fixed mounting arrangement of forming rolls of the prior art as compared with the flexible mounting of forming rolls in accordance with the present invention. The ability of the forming rolls 9, as shown in FIG. 10, to assume a position in which forces acting on the roller by virtue of the tendency of the strip to resist bending, results in the forming rolls 9 assuming a position in which the loading is spread to a plurality of points on the work surface of the forming roll 9, thus avoiding the concentrated loading, unbalanced force distribution, and excessive wear and roll marks which tend to occur with conventional machinery.

Figure 11:
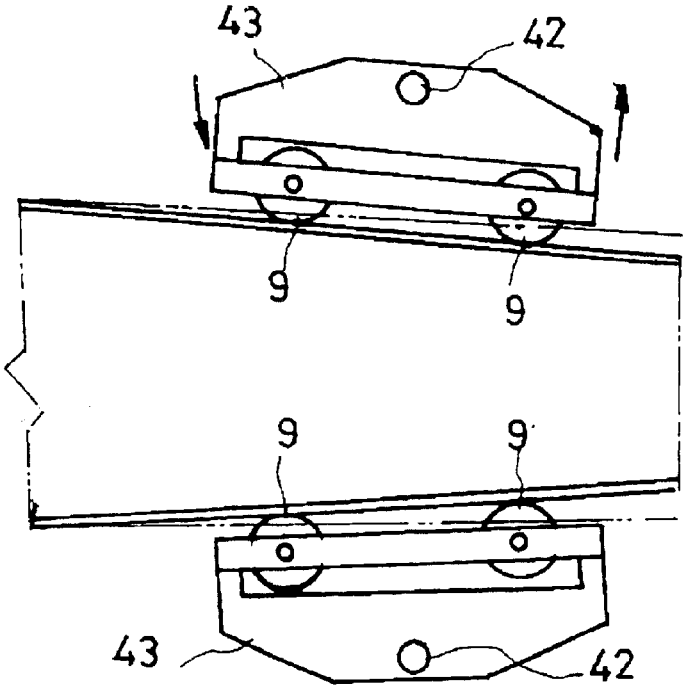
FIGS. 11 and 12 are schematic diagrams showing the interaction between the flexibly mounted rolls of the present invention and the sheet being processed by such rolls.
Figure 12:
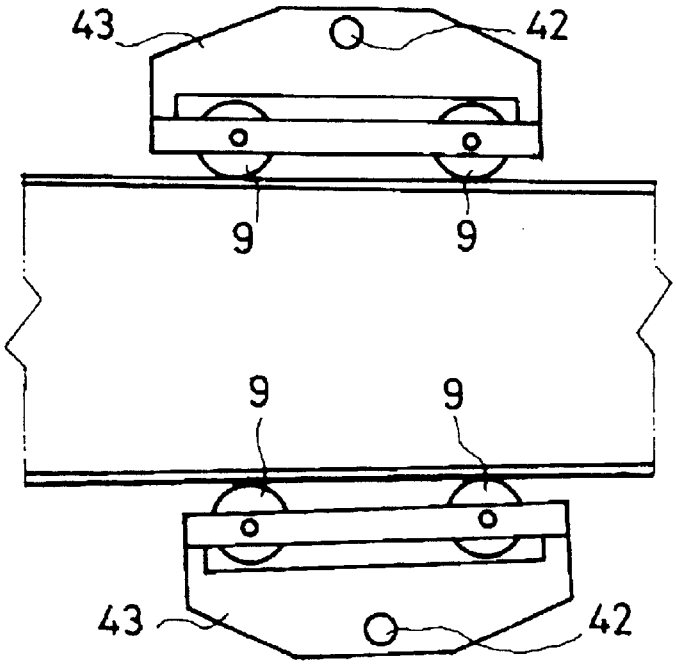
Figure 13:
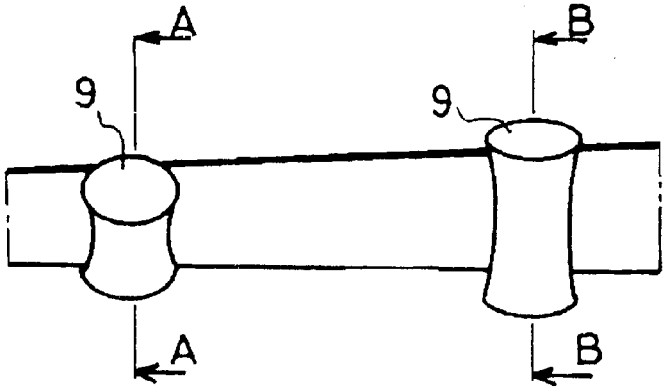
Fig. 13 (PRIOR ART)
FIGS. 13 through 15 are schematic diagrams of a prior art mounting arrangement for forming rolls.
Figure 14:
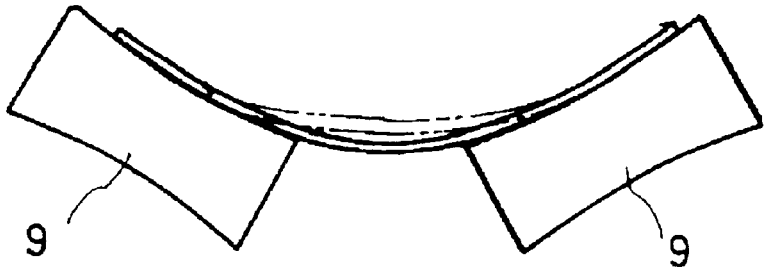
Fig. 14 (PRIOR ART)
Figure 15:
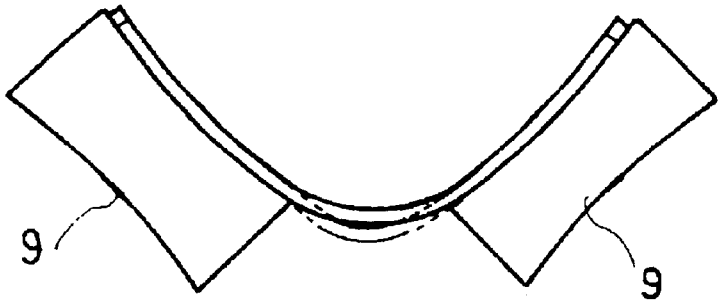
Fig. 15 (PRIOR ART)

Comparison of FIGS. 11 and 12 with FIGS. 13, 14 and 15 shows the advantage of mounting the forming rolls 9, as a pair, onto a pivoting frame 43. This arrangement allows an even distribution of force to be applied, thus avoiding concentrated loads and the resulting roll marks which occur with the conventional arrangement as is shown in FIGS. 13, 14 and 15. While it should be recognized that certain advantages of the present invention can be achieved by simply mounting a single roller with the freedom of rotation which is shown in FIG. 10, mounting a pair of rollers with three-axis freedom as shown in FIGS. 11 and 12 (as well as being shown in FIGS. 6 through 8) is a particularly advantageous embodiment of the present invention.

Figure 16:
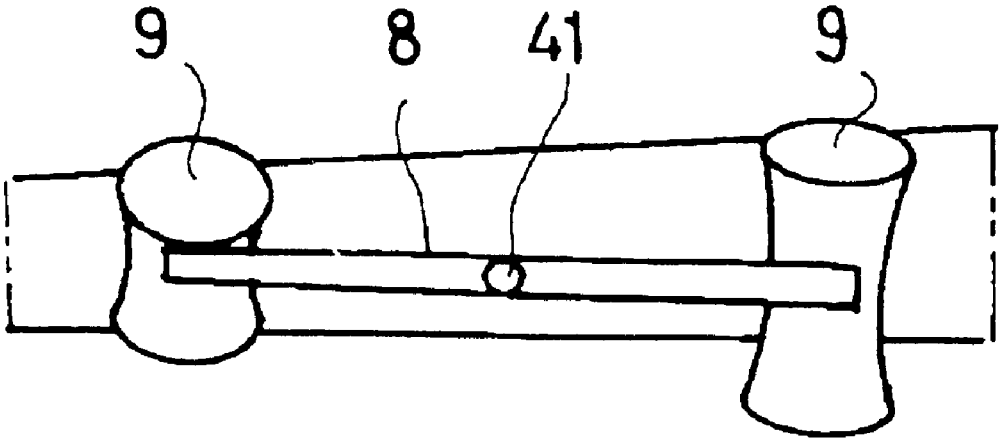
FIG. 16 is a schematic diagram showing the flexibility of the mounting arrangement of the present invention.

FIG. 16 shows the independent moveability of the two forming rolls 9 mounted on a single pivot frame. Each of the forming rolls mounted within a pivot frame of the present invention is free to assume an orientation in the X-Y direction depending upon the particular interface of that roller with a strip as it passes through a cage roll stand. This independent rotatability of the forming rolls results in substantially reduced tendency for the strip to engage in a twisting deviation from the planned pathway. The moveability of the pivot frame 43 about the swivel bearing 40 results in much improved threading of a strip through the machine at the start up phase of a tube forming operation. Finally, the three-axis freedom with which the forming rolls of the present invention are mounted results in a substantial reduction in the extent to which tubes are marked with roll marks of the type which are typically imparted to a tube with forming rolls which are fixed in a position in accordance with conventional tube forming machinery.

Although the invention claimed below has been described with reference to a specific mounting arrangement and components, other arrangements and components equivalent to those described herein may be substituted, and portions of the machines shown and described herein may be employed to practice the invention in other ways. Indeed, numerous variations, modifications and alternatives will be apparent to persons of skill in the art, and all such variations, modifications and alternatives are intended to be included within the spirit and scope of the invention as set forth in the appended claims.

What is claimed is:

1. A roller assembly for a tube making machine comprising at least one roller having a sheet engaging surface, said roller being supported by and rotatable on a roller shaft, said roller shaft defining a roller axis, said shaft being supported by a shaft holder, said shaft holder allowing said roller to rotate about said roller axis, said shaft holder being freely rotatable about a shaft holder axis, said shaft holder axis being generally perpendicular to said roller axis, whereby said roller is moveable about said roller axis and pivotable about said shaft holder axis.

2. A roller assembly in accordance with claim 1 wherein:

said assembly includes at least two rollers, a first roller and a second roller, said first roller being supported by and rotatable about a first roller shaft, said first roller shaft defining a first roller axis, and said second roller being supported by and rotatable about a second roller shaft, said first roller shaft being rotatably supported by a first shaft holder, said second roller shaft being rotatably supported by a second shaft holder, said first shaft holder having a first shaft holder axis, and said second shaft holder being a second shaft holder axis, said first and second shaft holders being supported on a roller assembly frame, said roller assembly frame being pivotable about a roller assembly pivot axis, whereby each of said rollers is able to rotate about a roller axis, a shaft holder axis and a roller assembly pivot axis.

3. A roller assembly in accordance with claim 2 wherein:

said first and second shaft holder are adjacent to each other and said first and second shaft holder axes are generally coaxial.

4. A roller assembly in accordance with claim 1 wherein:

said roller shaft is supported on opposite ends of said roller, and said shaft holder includes a roll frame with swing shafts on opposite sides of said roll frame, said swing shafts being coaxial and defining said shaft holder axis.

5. A roller assembly in accordance with claim 3 wherein:

said first shaft holder includes a first roll frame and a said second shaft holder includes a second roll frame, said first roll frame being, rotatably supported by a first pair of swing shafts and second roll frame being, rotatably supported by a second pair of swing shafts, said first and second pairs of swing shafts being generally coaxial and being supported by said roller assembly frame.

6. A roller assembly in accordance with claim 2 wherein:

said roller assembly frame pivots on said roller assembly pivot axis about a main pivot shaft, said main pivot shaft being carried by a swivel bearing, said swivel bearing allowing rotational movement of said roller assembly frame about a swivel axis, said swivel axis being transverse to said roller assembly pivot axis.

7. A mounting arrangement for a roller comprising:

a shaft about which said roller is free to rotate about a first roller shaft and defining a roller axis, a shaft support holding at least one end of said shaft, said shaft support being free to rotate about a shaft holder axis, and said roller being free to pivot about said shaft support axis, said shaft support being carried by a base which is free to swivel about a swivel axis.

8. A mounting arrangement for a roller in accordance with claim 7 wherein:

said roller is a first roller of a plurality of rollers operating in tandem with one another, and said mounting arrangement includes a second roller free to rotate about a second roller shaft and defining a second roller axis, and a second shaft holder which holds said second shaft, and said first and second shaft holders are supported by a pivot frame rotatable about a pivot pin allowing planar motion of said rollers in tandem, said pin being carried by said base.

9. A mounting arrangement for a roller in accordance with claim 8 wherein:

said plurality of rollers are parts of a tube forming machine in which a series of forming stations shape a tube from a strip of material into a tubular shape along a pathway, each said plurality of rollers having a concave forming surface, said plurality of rollers being oriented such that the roller axis of each shaft roller is generally transverse to said pathway and the shaft holder axis of each roller extends in a direction generally parallel to said pathway, and said pivot pin is generally vertically oriented, with said planar motion being generally horizontal, and said swivel axis is generally horizontal.

10. In a machine for shaping elongate material with a series of forming rollers disposed along a pathway, a roller mount comprising:

a shaft about which at least one roller is free to rotate, said shaft being generally perpendicular to said pathway, first roller support means for allowing pivoting movement of said shaft about said pathway, and swivel means for allowing swiveling movement of said shaft in a plane generally parallel to said pathway.

11. A roller mount in accordance with claim 10 wherein:

said mount carries a plurality of rollers and each of said plurality of rollers has a shaft about which one of said rollers is free to rotate, and said first roller support means supports a first shaft and a second roller support means supports a second shaft, and each of said first and second roller support means shaft is moveable to allow each of said first and second roller to move in a plane generally perpendicular to said pathway, said mount including roller support pivot means for holding said first and second roller support means and for allowing pivoting movement of said rollers carried by said mount toward and away from said pathway.

* * * * *